United States Patent [19]

Cook

[11] 3,937,031

[45] Feb. 10, 1976

[54] COOLING SYSTEM AND METHOD OF COOLING

[75] Inventor: Neal A. Cook, Racine, Wis.

[73] Assignee: Modine Manufacturing Company, Racine, Wis.

[22] Filed: Oct. 25, 1974

[21] Appl. No.: 517,936

[52] U.S. Cl. ..... 62/98; 62/507; 62/514 R; 174/15 C

[51] Int. Cl.[2] ..... F25D 17/02

[58] Field of Search ..... 123/41.01; 62/62, 514, 62/506.7, 98, 99; 174/15 C

[56] References Cited

UNITED STATES PATENTS

| | | | |
|---|---|---|---|
| 2,278,242 | 3/1942 | Chapman | 123/41.01 X |
| 3,221,719 | 12/1965 | Ulrich | 123/41.01 |
| 3,238,736 | 3/1966 | Macintosh | 62/63 |

*Primary Examiner*—William E. Wayner
*Assistant Examiner*—Ronald C. Capossela
*Attorney, Agent, or Firm*—Wegner, Stellman, McCord, Wiles & Wood

[57] ABSTRACT

A cooling system for cooling a hot material comprising a cooling chamber, a heat exchanger in the chamber, gas circulating means for forcing a cooling gas within the chamber in a closed circuit that includes cooling contact with the heat exchanger, means for passing the hot material from a source thereof through the heat exchanger and back to the source and means for selectively providing an additional cooling medium to the cooling system such as a flowable cryogen and particularly a cryogen gas.

12 Claims, 1 Drawing Figure

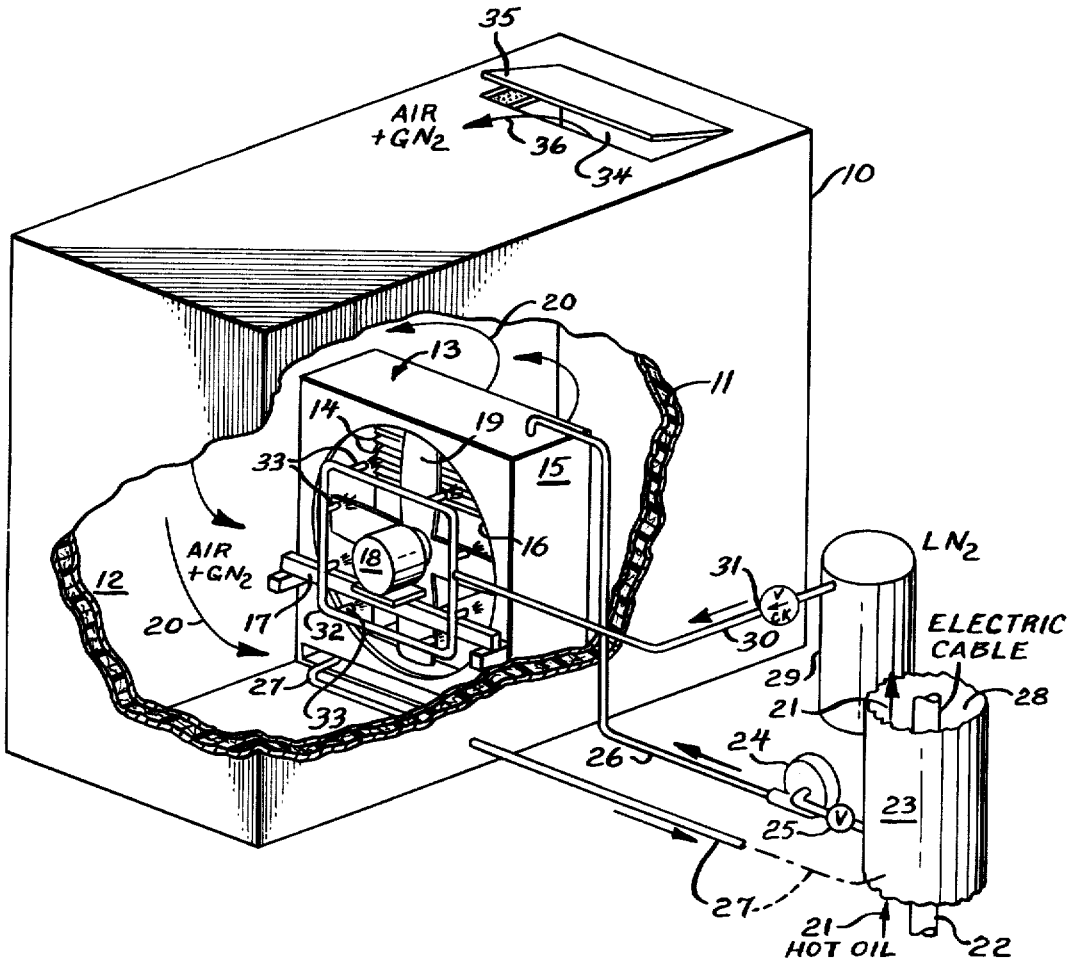
35
AIR
+GN2
36
34
10
20
13
11
14
19
33
15
16
18
AIR
+GN2
12
20
17
32
27
33
31
LN2
30
ELECTRIC
CABLE
29
21
28
24
26
23
25
27
21
HOT OIL
22

COOLING SYSTEM AND METHOD OF COOLING

Background of the Invention

One of the features of this invention is to provide an improved cooling system to supply supplemental cooling when required to cool a hot fluid when the normal cooling means for this fluid is insufficient to compensate for an abnormal heat buildup therein. Thus the cooling system of this invention is not ordinarily called upon to function so long as the cooling demands are not excessive.

The most pertinent prior art of which applicant is aware are U.S. Pat. Nos. 3,564,866 and 3,646,243 but neither of these, although relating to cooling apparatus, discloses the features of the present invention.

Brief Description of the Drawing

The single FIGURE of the accompanying drawing is a perspective view partially broken away of an apparatus showing one embodiment of the invention.

Description of the Preferred Embodiment

In the embodiment illustrated in the accompanying drawing there is provided a cooling chamber 10 having the walls thereof insulated as indicated by the insulation 11 and located within the interior 12 of the chamber is a heat exchanger 13 of a customary and well known type having open tubular coils 14 supported in a casing 15 with the casing having an open back 16 and a transverse bar 17 which comprises mounting means for supporting a gas circulating means embodied in an electric motor 18 and a fan or blower 19 rotated thereby. Thus the gas circulating means forces gas through the open back 16 and over and between the coils 14 and back again in a cooling circuit identified by the arrows 20.

The cooling system cools a hot material here embodied in a cooling oil 21 for an electric cable 22 with the oil being passed through an enclosing casing 23 that surrounds the cable 22 and serves as a confining oil path of a customary type as illustrated in the above prior U.S. Pat. No. 3,646,243.

During ordinary operation the oil coolant 21 will be sufficient to cool the cable 22 sufficiently. In extraordinary situations such as where peak loads are encountered the circulating oil 21 will not be sufficient to remove heat from the cable 22. In those instances the cooling system of this invention is used to provide additional cooling.

In order to provide this additional cooling a pump 24 of the ordinary electrically operated type is used to direct oil from the casing 23 by way of a control valve 25 into an oil line 26 which leads to the coils 14 of the tubular heat exchanger for cooling by the blast of cooling gas 20 from the blower 19. After circulating through the heat exchanger 13 in the cooling chamber 10 the now cooler oil is returned to the casing 23 by a return line 27 to any point desired in the cooling circuit 28 for the chamber 22.

In order to provide additional cooling there is provided a source of an additional cooling medium, here shown as a source of a vaporizable liquid cryogen which may be any of the ordinary types such as liquid nitrogen, liquid air, liquid carbon dioxide and the like. In the illustrated embodiment this source is a tank 29 of liquid nitrogen in which the liquid nitrogen is maintained under pressure and when needed is directed through a cryogen supply line 30 by way of a control valve 31 into a loop spray head 32 located at the rear of the fan or blower 19, with this spray head having spaced nozzles 33 spraying jets of cryogen from the rear of the blower and into the circulating cooling gas stream 20. The cryogen being vaporizable provides additional cooling gas to this gas circuit 20 for cooling the high temperature hot material which in this case is the oil from the cooling circuit 28 and thereby provides the additional cooling when needed.

The heat insulation 11 insulates the interior 12 of the cooling chamber from the ambient which is normally hotter than the coolant gases within the space 12. The chamber is provided with vent means 34 shown schematically in the drawing as an opening which may be closed by a cover 35. This vent 34 is for venting gases from the chamber as indicated by the arrow 36 in an amount to compensate at least approximately for the amount of cryogen gas introduced by the means for selectively providing additional cooling medium. In the illustrated embodiment these vented gases comprise a mixture of air and gaseous nitrogen. In this embodiment the liquid nitrogen is identified as $LN_2$ and gaseous nitrogen as $GN_2$.

Thus in the illustrated embodiment, when the operating conditions of the electric cable 22 are what is considered normal, the cooling oil circuit 24-28 will be sufficient to cool the cable properly. Under abnormally high temperature conditions, however, the cooling may be augmented by selectively providing the additional cooling. Where the additional cooling required is moderate this can be done by directing the cooling oil from the circuit 28 by way of a forced pump 24 through the tubular coil 14 and back into the cooling circuit 28. During this passage the oil passing through the coils 14 will be cooled by the circulating air stream 20 within the chamber 10.

When the cooling required is greater than moderate, however, additional cooling is provided by directing a vaporizable cryogen through the control valve 31 and the line 30 into the spray nozzles 33 during which the cryogen becomes vaporized and joins the cooling gas circuit 20 with the result that the temperature of this circuit is reduced suddenly and effectively to provide the additional cooling required depending upon the rate of flow of the liquid cryogen through the supply line 30 and the spray head loop 32 containing the spray nozzles 33.

This invention is useful with systems that are subjected to peak load cooling requirements such as cooling electrical transmission lines where oil is circulated through the line to reduce heat as in the illustrated embodiment, cooling of engine generators, cooling of gas or oil pump systems and the like.

In the illustrated embodiment the cooling heat exchanger 13 is a standard unit with the one shown being manufactured by the assignee as their "Albraze" industrial oil cooler having the fan 19 and motor 18 attached.

Having described my invention as related to the embodiment shown in the accompanying drawing, it is my intention that the invention be not limited by any of the details of description unless otherwise specified, but rather be construed broadly within its spirit and scope as set out in the appended claims.

I claim:

1. A cooling system for cooling a hot material, comprising: a cooling chamber; a heat exchanger in said chamber occupying only a fraction of a cross sectional space in said chamber; gas circulating means for forcing a cooling gas within said chamber in a closed circuit within said space in said chamber that includes cooling contact with said heat exchanger; a source of hot material externally of said chamber; means for passing said hot material from said source through said heat exchanger and back to said source; and means for selectively providing an additional cryogenic gaseous cooling medium to the cooling gas in said closed cooling gas circuit.

2. The system of claim 1 wherein said means for providing said additional cooling medium comprises means for introducing a vaporizable cryogen and thereby additional cooling gas to said closed circuit of said cooling gas and there are provided insulating means for heat insulating said chamber from its ambient and vent means for venting gases from said chamber to said ambient in an amount to compensate for the cryogen gas introduced by said cryogen means.

3. The system of claim 1 wherein said hot material is a fluid, said heat exchanger and gas circulating means comprise a cooling unit comprising a casing, heat exchange coil means mounted therein and mounting means on said casing for supporting said gas circulating means, and there are provided means for directing said hot material fluid through said coil means.

4. The system of claim 1 wherein said hot material comprises a fluid, said heat exchanger and gas circulating means comprise a cooling unit comprising a casing, heat exchange coil means mounted therein and mounting means on said casing for supporting said gas circulating means, and said circulating means comprises a motor driven blower, said means for providing said additional cryogenic gaseous cooling medium comprises means for introducing a vaporizable liquid cryogen and thereby additional cooling gas to said closed circuit of said cooling gas on the upstream side of said heat exchanger relative to said cooling gas circuit.

5. The system of claim 4 wherein said gas circulating means comprises a blower with a gas inlet side and a gas outlet side adjacent to said heat exchanger, and said means for introducing said cryogen comprises a conduit for said liquid cryogen having a plurality of spray nozzles at said gas inlet side.

6. A method for cooling hot material, comprising: providing a cooling chamber having a heat exchanger therein occupying only a fraction of a cross sectional space in said chamber; forcing a cooling gas within said chamber in a closed circuit in said chamber that includes cooling contact with the heat exchanger; passing said hot material from a source thereof externally of said chamber through said heat exchanger and back to said source; and selectively providing when needed an additional vaporizable liquid cryogenic cooling medium to the closed cooling gas circuit for providing supplemental cooling for said hot material during its passage through said heat exchanger.

7. The method of claim 6 wherein said hot material comprises a heated fluid and said additional vaporizable liquid cryogenic cooling medium is introduced at the upstream side of said heat exchanger in relation to the cooling gas circuit.

8. The method of claim 7 wherein said cooling gas within said chamber is vented to ambient in an amount corresponding to the amount of said cryogen gas introduced for the additional cooling.

9. Apparatus, comprising: a heated member; cooling means therefor including means for contacting said member with a cooling fluid material that becomes heated during said contact to become a hot fluid material; a cooling chamber separate from said heated member; a heat exchanger in said chamber occupying only a fraction of a cross sectional space in said chamber; gas circulating means for forcing a cooling gas within said chamber in a closed circuit within said space in said chamber that includes cooling contact with said heat exchanger, said heat exchanger and gas circulating means comprises a cooling unit comprising a casing, heat exchange coil means mounted therein and mounting means on said casing for supporting said gas circulating means; means for passing said hot fluid material through said heat exchanger and back to said heated member; means for introducing a vaporizable cryogen and thereby additional cooling gas to said closed circuit of said cooling gas for selectively providing when needed an additional cooling medium to said cooling gas circuit in said chamber; and means for directing said hot fluid material through said coil means.

10. The apparatus of claim 9 wherein said means for providing said additional cooling medium comprises means for introducing a vaporizable cryogen and thereby additional cooling gas to said closed circuit of said cooling gas on the upstream side of said heat exchanger relative to said cooling gas circuit, said gas circulating means blower has a gas inlet side and a gas outlet side adjacent to said heat exchanger, and said means for introducing said cryogen comprises a conduit for a liquid cryogen having a plurality of spray nozzles at said gas inlet side.

11. A method for cooling a hot material, comprising: contacting a heated member with a cooling material that becomes heated during said contact to become a hot material; providing a cooling chamber separate from said heated member and a heat exchanger in said chamber occupying only a fraction of a cross sectional space in said chamber; forcing a cooling gas within said chamber in a closed circuit in said chamber that includes cooling contact with the heat exchanger; passing said hot material from said heated member through said heat exchanger and back to said heated member; and selectively providing an additional cooling medium to the cooling gas circuit during excess heat loads of said hot material for providing supplemental cooling for said hot material during its passage through said heat exchanger by supplying a vaporizable cryogen to said gas circuit on the upstream side of said heat exchanger in relation to the cooling gas circuit.

12. The method of claim 11 wherein said cooling gas is vented from said circuit to ambient in an amount corresponding to the amount of said cryogen gas introduced for the additional cooling.

* * * * *